US012740647B2

(12) United States Patent
Goodworth

(10) Patent No.: US 12,740,647 B2
(45) Date of Patent: Sep. 22, 2026

(54) STACKABLE CHAIR HAVING CUP HOLDER AND FOLDING TABLE

(71) Applicant: Adams Mfg. Corp., Portersville, PA (US)

(72) Inventor: Matthew Goodworth, Pittsburgh, PA (US)

(73) Assignee: Adams Mfg. Corp., Portersville, PA (US)

( * ) Notice: Subject to any disclaimer, the term of this patent is extended or adjusted under 35 U.S.C. 154(b) by 116 days.

(21) Appl. No.: 18/980,662

(22) Filed: Dec. 13, 2024

(65) Prior Publication Data

US 2026/0165487 A1 Jun. 18, 2026

(51) Int. Cl.

| | |
|---|---|
| ***A47C 7/62*** | (2006.01) |
| ***A47C 7/70*** | (2006.01) |
| *A47C 1/14* | (2006.01) |

(52) U.S. Cl.

CPC ..... *A47C 7/70* (2013.01); *A47C 7/622* (2018.08); *A47C 7/624* (2018.08); *A47C 1/14* (2013.01)

(58) Field of Classification Search

CPC ..... A47C 7/70; A47C 7/622; A47C 7/624
See application file for complete search history.

(56) References Cited

U.S. PATENT DOCUMENTS

| | | | | |
|---|---|---|---|---|
| 4,798,413 | A | 1/1989 | Capelli | |
| 7,198,327 | B2 | 4/2007 | Bergin | |
| 7,243,991 | B2 | 7/2007 | Ojeda | |
| 7,290,746 | B1 | 11/2007 | Macias et al. | |
| 8,191,963 | B2 | 6/2012 | Gamboa | |
| 10,104,594 | B2 | 10/2018 | Benammar et al. | |
| D840,708 | S | 2/2019 | Melaragno | |
| 10,231,550 | B2 | 3/2019 | Weirun | |
| 10,285,505 | B2 | 5/2019 | Summerville | |
| 10,463,156 | B2 | 11/2019 | Jaeckel | |
| 10,537,171 | B2 | 1/2020 | Melaragno | |
| 10,772,435 | B2 * | 9/2020 | Bergin | A47C 7/62 |
| 11,453,323 | B2 * | 9/2022 | Nowak | B60N 3/102 |
| 11,819,140 | B2 * | 11/2023 | Qi | A47C 7/624 |
| 12,161,229 | B2 * | 12/2024 | Reinhart | A47C 3/04 |
| 2006/0220423 | A1 * | 10/2006 | Bergin | A47C 7/624 297/160 |
| 2015/0223609 | A1 | 8/2015 | Prokofiev et al. | |
| 2022/0373253 | A1 * | 11/2022 | Roman | F25D 3/08 |

FOREIGN PATENT DOCUMENTS

| | | | | |
|---|---|---|---|---|
| KR | 200347204 Y1 * | 4/2004 | | A47C 11/005 |
| KR | 200479411 Y1 | 1/2016 | | |
| KR | 2017-0110927 A | 10/2017 | | |
| KR | 2018-0002043 U | 7/2018 | | |

* cited by examiner

*Primary Examiner* — Timothy J Brindley
(74) *Attorney, Agent, or Firm* — Buchanan Ingersoll & Rooney PC

(57) ABSTRACT

A chair having a cylindrical cup holder and folding table has a circular opening in a chair arm and spaced-apart tabs that extend into the circular opening. A rotational stop is attached to the bottom surface of at least one tab. Locking tabs on the cup holder gaps between the spaced-apart tabs. When the cup holder is fully inserted into the circular opening the cup holder is rotated until the tabs extending from the cup holder each engage a rotational stop. A spring tab may be attached to the chair arm below each gap to help position the cup and act as a rotational stop. The folding table has a collar that has a spring tab with a tooth which mates with a circumferential groove on the inside surface of the cup holder.

9 Claims, 5 Drawing Sheets

STACKABLE CHAIR HAVING CUP HOLDER AND FOLDING TABLE

FIELD OF INVENTION

The invention relates to chairs in which there is a table attached to one or both arms of the chair.

BACKGROUND OF THE INVENTION

One type of chair, popular for use as outdoor furniture, is a molded plastic chair. These chairs are a single molded structure and are usually configured so that one chair may be stacked on another chair. Stackable chairs have an advantage in that they can be stacked upon one another and placed on a pallet for easy transport. A retailer may display the stacked chairs on the same pallet on which they have been shipped. Consumers may also store several stackable chairs stacked one upon another.

There are many types of chairs which have a cup holders, tray or table that is or can be attached to one or both arms of the chair. One type of chair has a circular opening in the top surface of the arm of the chair which is sized to receive a cup or other beverage container. The opening may be tapered to hold the cup with a friction fit or there may be a cup-shaped structure below the opening which holds the cup or beverage container. U.S. Pat. No. 8,191,963 B2 discloses a molded plastic chair having such an opening at the outer end of the left chair arm and an integrally molded plate holder on the top of the right chair arm.

Another type chair has a cup holder or tray that is mounted on and extends outward from the chair arm. Some such cup holders and trays are attached to the arm by straps or clamps and are removable from the chair arm when not in use. An example of this type of chair can be found in Published United States Patent Application No. 2006/0061155 A1. U.S. Pat. No. 10,537,171 B2 discloses a two-piece shelf having clamps to attach the shelf to a lounge chair. This type of table and cup holder may be cumbersome to attach and detach. The product may never fit snugly and securely and thus during use may slip or fall off from the weight of beverages or from being bumped. If this type of cup holder is stored separately from the chair, the cup holder can easily be misplaced or lost. Of course, this problem can be overcome by permanently attaching the cup holder to the chair arm. But cup holders, especially ones held on by straps or clamps, are not usually aesthetically pleasing. Furthermore, it would be difficult or impossible to securely stack two or more chairs that have this table or cup holder attached to an arm of the chair.

Yet, another type of chair has a cup holder or tray attached to the underside of a chair arm or to the arm support and can pivot or rotate between a closed position in which the cup holder or tray is nested under the arm of the chair for storage and an extended position for use. U.S. Pat. Nos. 8,182,031 B2 and 9,532,654 B1 disclose this type of cup holder. U.S. Pat. No. 6,361,105 B1 discloses a chair having an ashtray pivotably attached to the underside of the right chair arm and a cup holder pivotably attached to the underside of the left chair arm. While this type of tray and cup holder does not have many of the problems of the products described above, there are still serious issues with these products. When beverages are placed in the cup holder or on the tray, it may sag unacceptably due to a lack of structure especially near the fixed end where the forces are greater. Also, cup holders and trays that swing out to the side of the arm are put into a highly exposed position where at times they may get sat on or pushed down on or otherwise experience some manner of excessive loading or abuse. Accidental excessive loading may happen one or more times causing the cup holder or tray to crack. Because cup holders and trays of this type do not have a break-away mechanism excessive loading, could cause the chair arm to crack or break. Then the whole chair would be lost due to an issue with just the cup holder or tray. The cup holder or tray may not stay in the retracted position, swinging either partially or fully open, This could occur if the chair were on a slightly uneven surface, and the cup holder or tray swings toward a partially or fully closed position. A cup holder or tray that does not remain stationary in the open position may cause beverages to be in different positions relative to the chair arm or block the cup holder opening and thus prevent one from putting a beverage in the holder. This type of cup holder or tray may also prevent or impede stacking of the chair, as the cumulative height of the chair arm and the cup holder could be significant.

There are also a number of trays and tables which can be attached to the arm of a chair. U.S. Pat. No. 10,537,171 B2 discloses a two-piece shelf having clamps to attach the shelf to a lounge chair. A cup holder is provided on one of the two pieces. United States Design Patent No. D840,708 S also covers this product. Korean Patent No. 2017-0110927 discloses a portable folding table having a cylindrical support that is attached to a post on the underside of the table. The support is sized to fit into a cup holder on an arm rest of a chair. A cap having a slot is provided on the top of the support. The post fits within the slot to attach the support to the table. Grooves are provided in the bottom edge of the support that engage the cup holder. All of these trays and tables when attached to a chair arm prevent or impede stacking of the chair.

There is a need for a molded plastic chair having a cup holder and a table which can be stacked one upon another for storage and shipment. Preferably the table can be rotated from a storage position in which the table or substantially all of the table is above the chair arm to a position in which a portion of the table extends over the seat of the chair. Furthermore, the table should stay in either the storage position or the extended position after being placed in that position by the user. Preferably the cup holder and table will have sufficient structure to be able to withstand normal usage. The cup holder and the table should have definite, sturdy stops for when it has reached either its fully opened or fully closed positions. Rough-handling users should not be able to damage the cup holder or table by swiveling it beyond its fully-open or fully-closed position, and the table should, once closed, be aligned on its outer edge in parallel with the outside of the chair arm. Preferably the cup holder and the tray could be assembled quickly and easily either by hand or with a small mallet.

The cup holder should be capable of holding cups, cans, mugs, tumblers, wine glasses and all commonly used types of beverage bottles from which people routinely drink. Preferably the cup holder and table are made of that same or similar plastic as the chair to which it is attached.

SUMMARY OF THE INVENTION

I provide a chair having a cup holder that fits through an opening in an arm of the chair and can be locked in place and a folding table having a collar that fits into the cup holder and is locked in place. The chair has a seat, a back, legs attached the seat and a chair arm attached to at least one of the back and the seat. The chair arm has a circular opening and, a plurality of spaced-apart tabs extending from the chair arm into the circular opening, the tabs defining a selected number of gaps each gap being between adjacent tabs. All gaps should be a same size. Each tab has a bottom surface. A rotational stop is attached to the bottom surface of at least one tab, but preferably all tabs have a rotational stop.

The cup holder is positioned within the circular opening and has a circular bottom and a cylindrical wall attached to the circular bottom. There is a ring attached to and extending outwardly from the top edge of the circular wall. A selected number of locking tabs are attached to outer surface of the cylindrical wall. Each locking tab is sized and positioned to fit through the selected number of gaps. When the cup holder is fully inserted into the circular opening the cup holder is rotated until the tabs extending from the cup holder each engage a rotational stop. Preferably the amount of rotation is about 15 degrees. A spring tab may be attached to the chair arm below each gap or below one gap to help position the cup holder so that the cup holder can be rotated until each the tabs extending from the cup holder abut a respective rotational stop.

The interior of the cup holder may be configured to receive a collar that extends from the bottom of a folding table to enable the chair to securely hold that table. The collar has spring tabs and a tooth is provided on at least one of the spring tabs. When the collar is fully inserted into the cup holder the teeth will fit into a circumferential recess on the inner surface of the cup holder.

Other objects and advantages of my chair having a cup holder can be seen and understood from certain present preferred embodiments shown in the drawings.

DESCRIPTION OF THE PRESENT PREFERRED EMBODIMENTS

Figure 1:
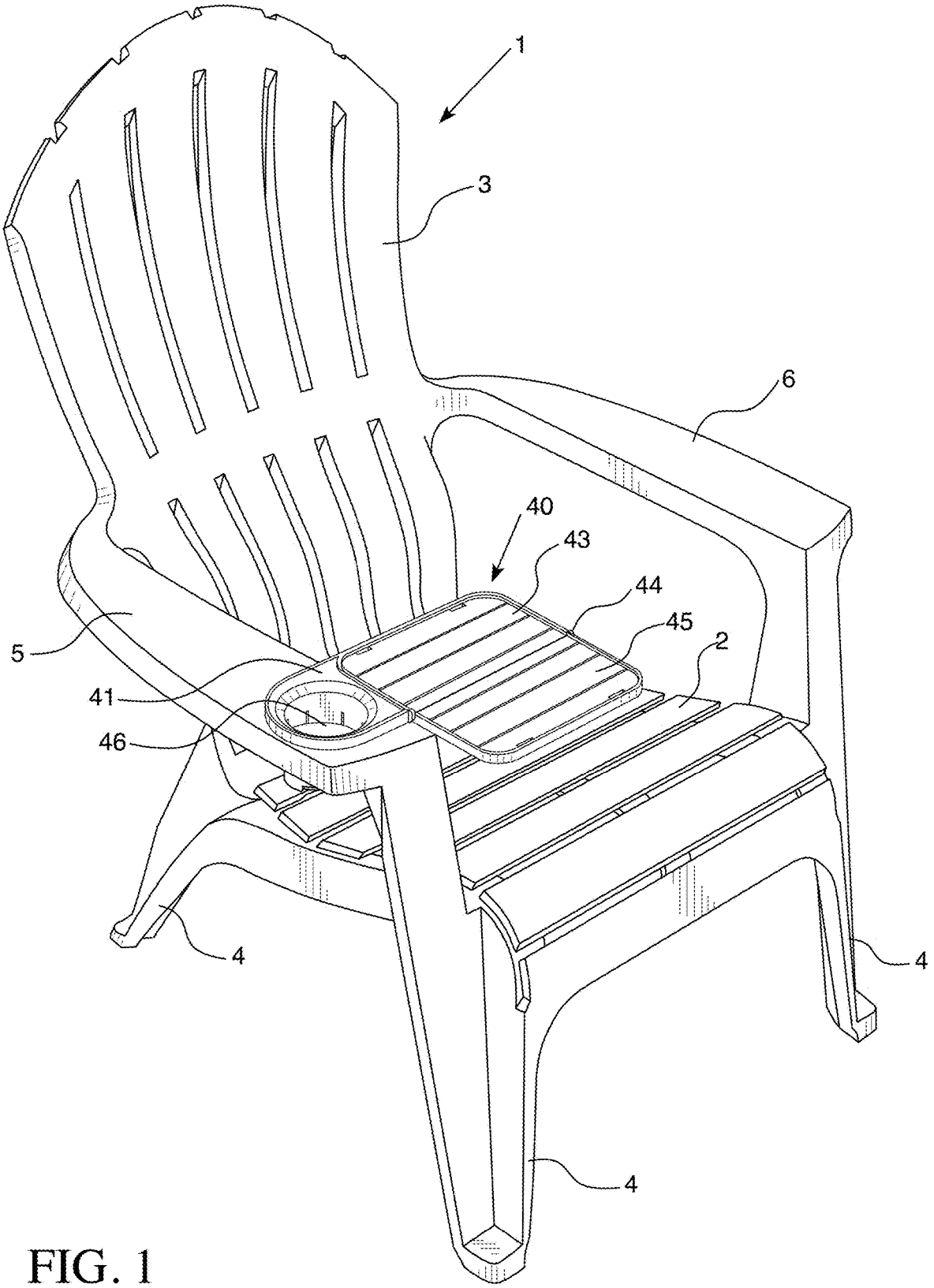
FIG. 1 is a perspective view of a present preferred embodiment of my chair having a cup holder and folding table in which the folding table is in an open, unfolded position.
Figure 2:
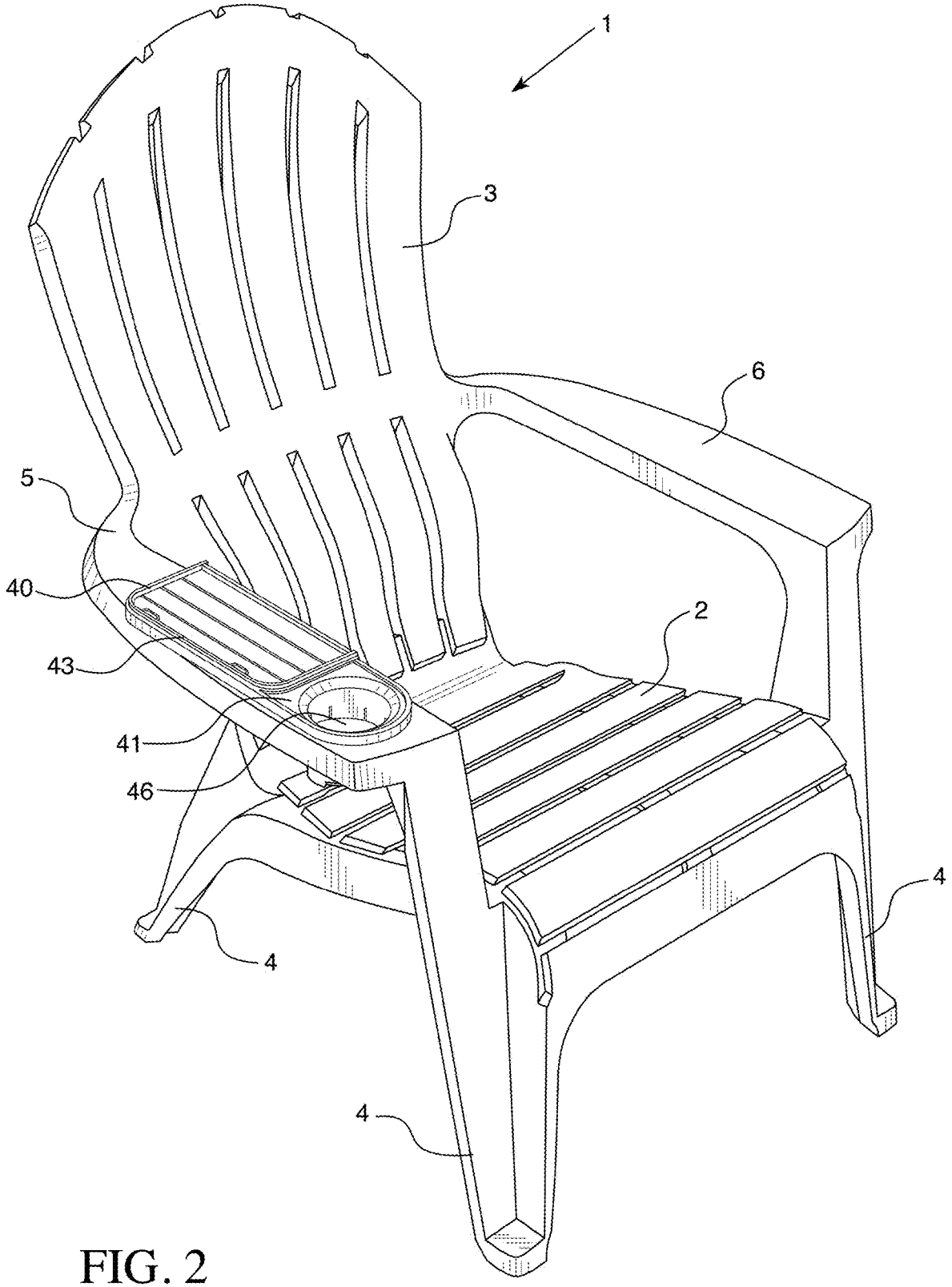
FIG. 2 is a perspective view similar to FIG. 1 showing the folding table in a closed, folded position.
Figure 3:
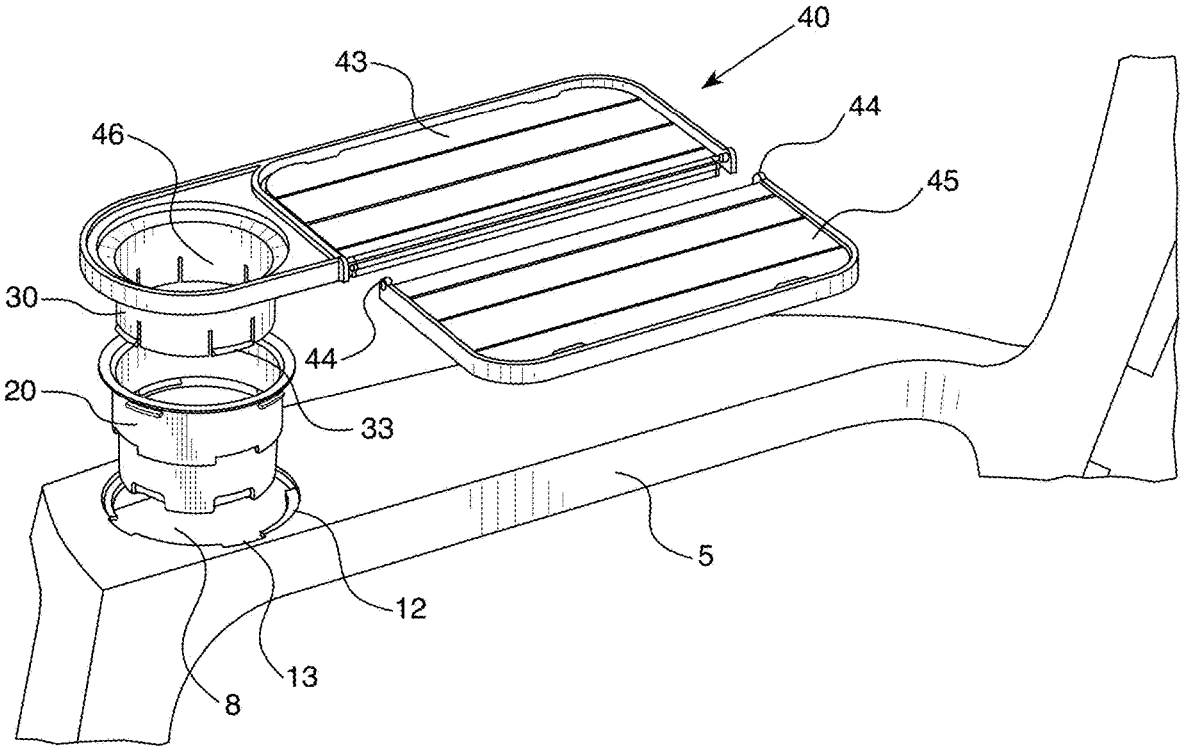
FIG. 3 is an exploded view of a portion of the chair shown in FIG. 1 showing the cup holder and folding table positioned above the circular opening in the chair arm that receives the cup holder.

Referring to FIGS. 1, 2 and 3 I provide a stackable molded plastic chair 1, having a seat 2, a back 3 attached to the seat, and legs 4 attached to the seat. A right arm 5 and a left arm 6 are connected to the back and the seat. As can be seen in FIG. 3 there is an opening 8 in the right arm which is sized to receive a cup holder 20. This opening could be in the left arm or there could be an opening that receives a cup holder in both the right arm and the left arm. Although the chair in FIGS. 1, 2 and 3 is a molded plastic Adirondack chair, my invention is not limited to that type of chair or to molded plastic chairs.

Figure 6:
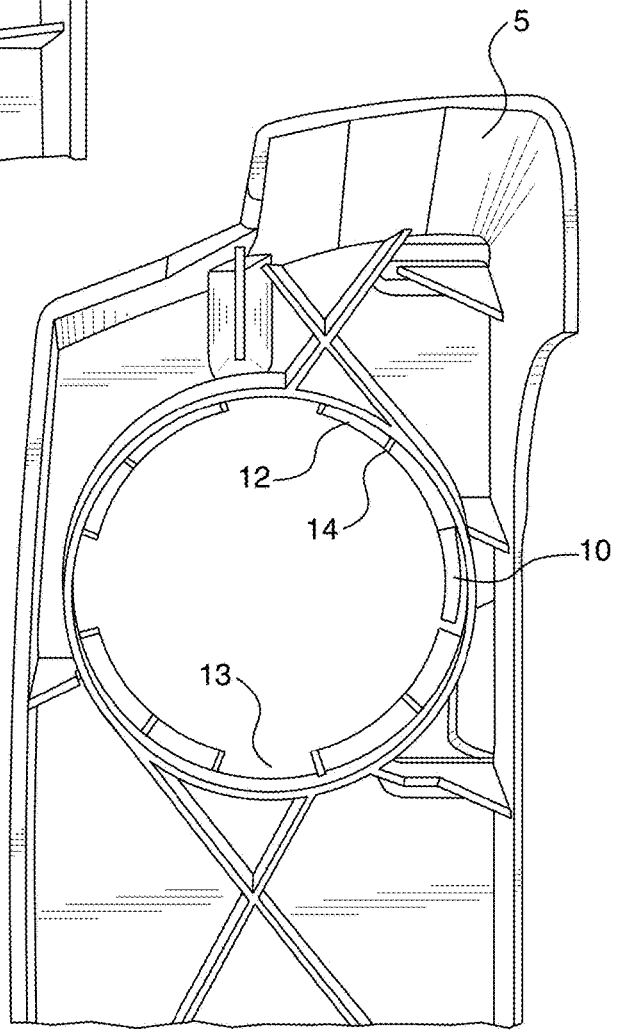
FIG. 6 is a bottom view similar to FIG. 5 showing the circular opening in a portion of the chair arm without the cup holder in the opening.
Figure 7:
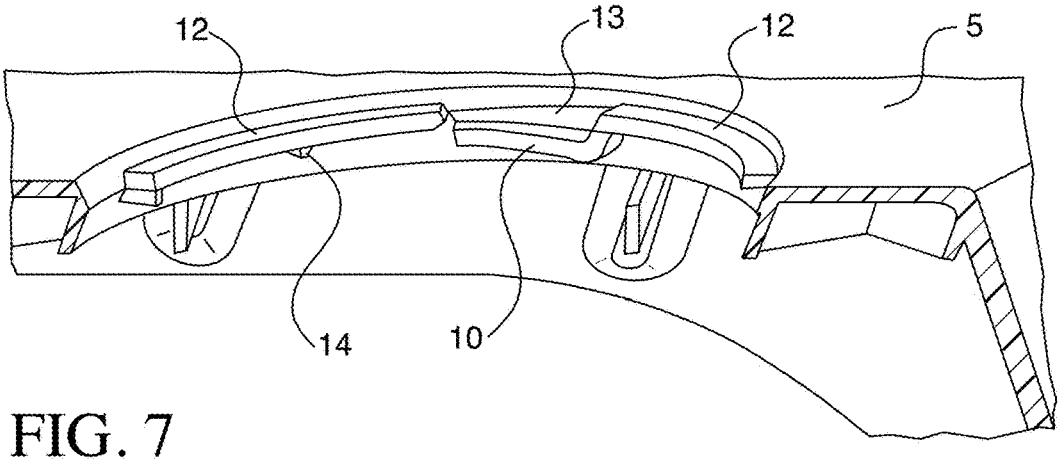
FIG. 7 is a sectional view showing a portion of the opening in the chair arm.

As can be seen in FIGS. 3, 6 and 7 there are four equally-spaced tabs 12 extending from the chair arm into the circular opening 8. There is a gap 13 between each pair of adjacent tabs. All of these gaps should be the same or about the same size. Referring to FIG. 7 there is a rotational stop 14 attached to the bottom surface of each tab 12. A spring tab 10 is attached to one end of one or more of the tabs 12 and extends below the opening 8 between that tab and the adjacent tab.

There are four tabs 22 on the cup holder 20 that pass through the gaps 13 when the cup holder is inserted into the opening 8. The cup holder must be inserted into the opening a sufficient distance so that the spring tabs or spring tab 10 is depressed sufficiently to enable the cup holder to be rotated until the tabs 22 on the cup holder engage a respective rotational stop 14 attached to the bottom surface of one or more of the tabs 22. I prefer that the amount of rotation be 15 degrees. At that point the tabs 22 on the cup holder 20 will have cleared the rotational spring or springs 10 and the rotational spring or springs will pop back up and act as a rotational stop.

Figure 4:
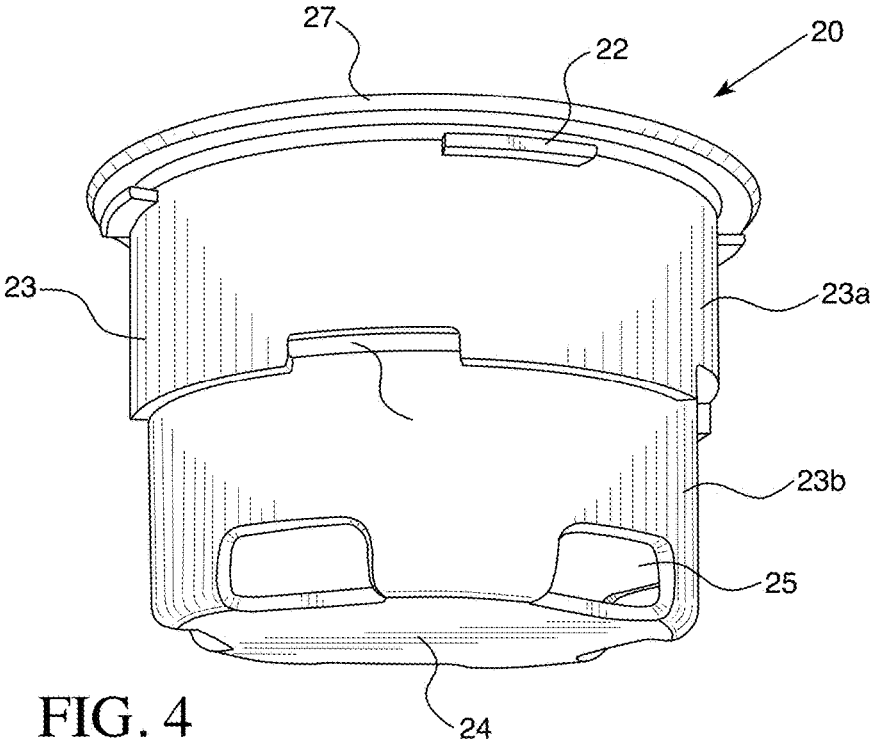
FIG. 4 is a perspective view of a present preferred embodiment of my cup holder.
Figure 5:
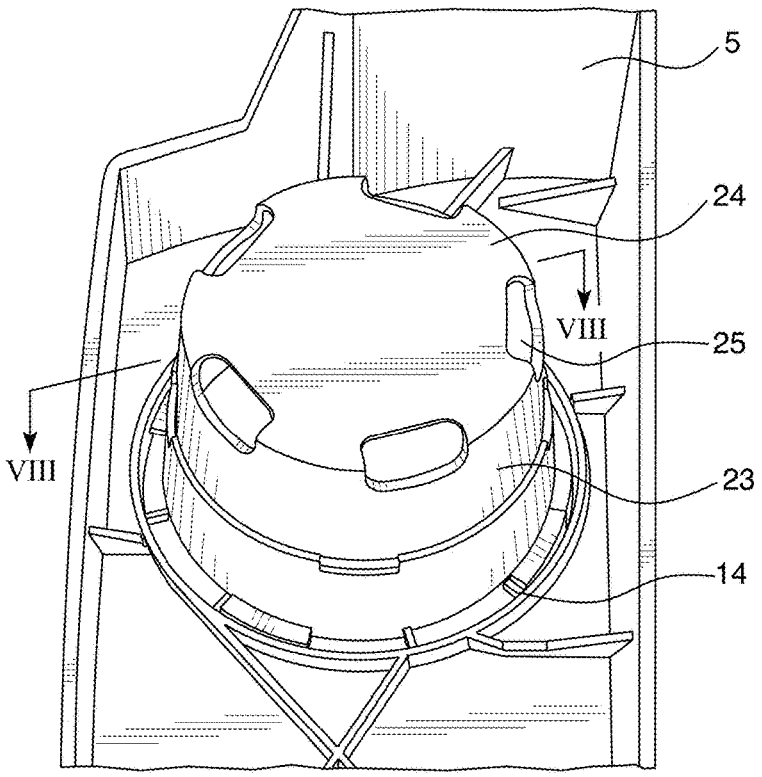
FIG. 5 is a bottom view of the cup holder and a portion of the chair arm shown in FIG. 3 positioned within the circular opening in the chair arm that receives the cup holder.
Figure 8:
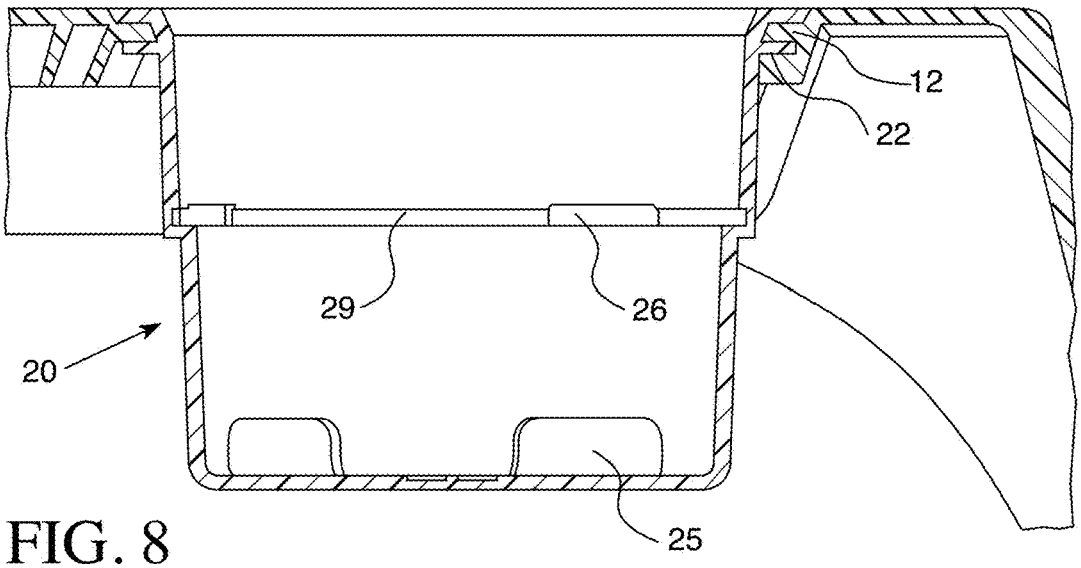
FIG. 8 is a sectional view taken along the line VIII-VIII in FIG. 5 and rotated 180°.

Referring now to FIGS. 4, 5 and 8, the cup holder 20 has a cylindrical body 21 and cylindrical wall 23 attached to a circular bottom 24. Drain holes 25 may be provided in the bottom of the cup holder. Vent holes 26 can be provided in the cylindrical wall 22. A ring 27 is attached to and extends outwardly from the top edge of the cylindrical wall. This ring is seated in the circumferential groove 18 surrounding the circular opening 8 in the chair arm 5. The tabs 22 attached to the cylindrical wall 23 of the cup holder are each sized and positioned to fit through the gaps 13, engage the a rotational stop 14 and allow each spring tab 10 to pop up to its original position when the tabs 22 are each adjacent to a rotational stop 14.

Figure 9:
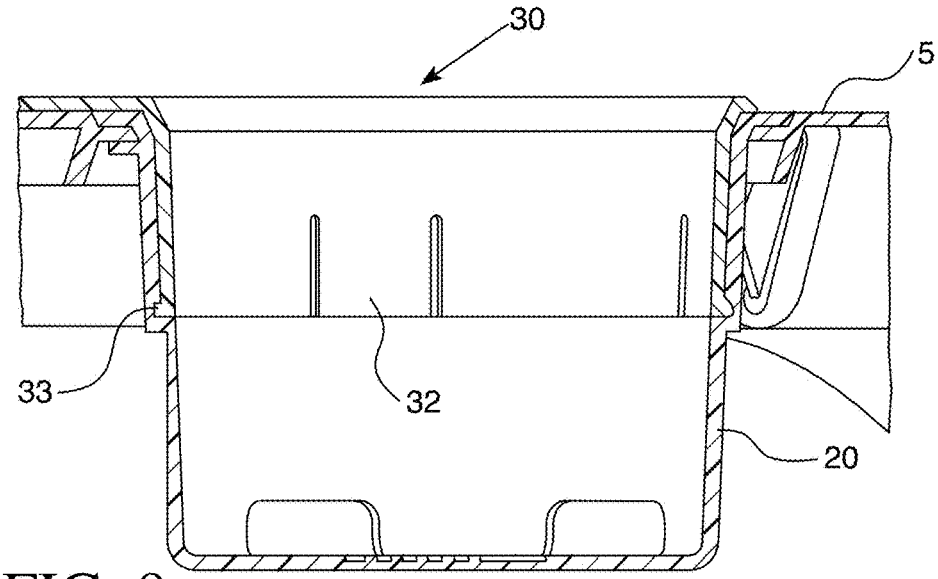
FIG. 9 is a sectional view similar to FIG. 8 with the collar inserted into the cup holder.

As can be seen most clearly in FIG. 4, I prefer that the cylindrical wall 23 have an upper portion 23*a* and a lower portion 23*b* in which the inner diameter of the upper portion is greater than the inner diameter of the lower portion and the outer diameter of the upper portion is greater than the outer diameter of the lower portion. This configuration allows the cup holder to receive a collar 30 that extends from the bottom of the folding table 40. FIG. 9 shows the collar 30 inserted into the cup holder 20. The collar has spring tabs 32. A tooth 33 is provided on at least some of the spring tabs. When the collar is fully inserted into the cup holder 20 the teeth will fit into a circumferential recess 29 at the base of the interior surface of the upper portion 23*a* of the cup holder 20 to hold the collar 30 in place. The vent holes 26 may be positioned so that the tooth on the spring tab is seated within a vent hole when the table is in the open, unfolded position shown in FIG. 1 or positioned in the closed, folded position shown in FIG. 2.

As can be seen in FIGS. 1, 2 and 3, the folding table 40 has a two halves, 41 and 42 which are connected together by hinges 44. The first half has a first table surface 43 and a circular opening 46 at one end that is sized to receive a cup. A collar 30 extends from the bottom surface of the first half 41 and surrounds the circular opening 46. The second half 42 has a second table surface 45 that preferably the same size as the first table surface 43. When the folding table is in a closed, folded position shown in FIG. 2, the second table surface will overlay the first table surface. The width of both the first table half and the width of the second table half should be substantially the same as the width of the chair arm. When the folding table is in the closed, folded position shown in FIG. 2, the folding table should not extend inward beyond the widest width of the chair arm so that when the folding table is in the closed, folded position the folding table will not impede stacking of similar chairs one upon another.

Although I have described and illustrated certain present preferred embodiments of my chair having a cup holder, it should be distinctly understood that my invention is not limited thereto but may be variously embodied within the scope of the following claims.

I claim:

1. A chair having a cup holder and folding table comprising;

a seat, a back attached to the seat;

legs attached to the seat;

a chair arm attached to at least one of the back and the seat, the chair arm having a circular opening, a plurality of spaced-apart tabs extending from the chair arm into the circular opening, the tabs defining a selected number of gaps between adjacent tabs, each tab having a bottom surface, a spring tab attached to one end of at least one tab and extends below the gap between that tab and an adjacent tab, and at least one rotational stop attached to the bottom surface of at least one tab;

a cup holder positioned within the circular opening, having a circular bottom, a cylindrical wall having a top edge and attached to the circular bottom, a ring attached to and extending outwardly from the top edge, a selected number of locking tabs attached to the cylindrical wall, each locking tab sized and positioned to fit through the selected number of gaps and engage the at least one rotational stop;

a folding table having a first half and a second half pivotably connected together so that the first half can be folded over the second half, the first half having a first table surface and a circular opening at one end that is sized to receive a cup; and a collar that extends from the bottom surface of the first half and surrounds the circular opening, at least a portion of the collar being within the cup holder.

2. The chair of claim 1 wherein the cup holder has a circumferential groove on an inner surface of the cup holder and the collar is comprised of at least one spring tab having a tooth which is in the circumferential groove.

3. The chair of claim 1 wherein in which the cup holder has an upper portion having an upper interior surface and a first inner diameter and a lower portion having second inner diameter, the first inner diameter being greater than the second inner diameter.

4. The chair of claim 3 wherein the upper interior surface has a circumferential groove and also comprising a collar having spring tabs and a tooth on at least one of the spring tabs, the collar being within the upper portion and the tooth being within the circumferential groove.

5. The chair of claim 4 wherein the cup holder has an opening in the cylindrical wall at the circumferential groove, the opening sized to receive the tooth.

6. The chair of claim 1 wherein the gaps between adjacent tabs that extend into the circular opening are a same size.

7. The chair of claim 1 wherein the plurality of spaced-apart tabs extending from the chair arm into the circular opening are equally spaced.

8. The chair of claim 1 wherein the first half and second half of the folding table are sized so that when the folding table is in a closed, folded position over a chair arm having a widest width the folding table has width that is not greater than the widest width of the chair arm.

9. The chair of claim 1 wherein the chair is a molded plastic chair.

* * * * *